US005620027A

United States Patent [19]

Sato

[11] Patent Number: 5,620,027

[45] Date of Patent: Apr. 15, 1997

[54] POPPET TYPE DIRECTIONAL CONTROL VALVE

[75] Inventor: Hideharu Sato, Yawara-mura, Japan

[73] Assignee: SMC Corporation, Tokyo, Japan

[21] Appl. No.: 560,976

[22] Filed: Nov. 20, 1995

[30] Foreign Application Priority Data

Dec. 29, 1994 [JP] Japan ..... 6-339640

[51] Int. Cl.[6] ..... F15B 13/042

[52] U.S. Cl. ..... 137/625.66; 137/625.27

[58] Field of Search ..... 137/625.66, 625.27

[56] References Cited

U.S. PATENT DOCUMENTS

| | | | |
|---|---|---|---|
| Re. 34,261 | 5/1993 | Sule | 137/625.5 |
| 3,820,567 | 6/1974 | Bouteille | 137/625.66 |
| 4,630,645 | 12/1986 | Spa | 137/625.66 X |

FOREIGN PATENT DOCUMENTS

| | | | |
|---|---|---|---|
| 1902866 | 4/1970 | Germany | 137/625.66 |

*Primary Examiner*—Gerald A. Michalsky
*Attorney, Agent, or Firm*—Oblon, Spivak, McClelland, Maier & Neustadt, P.C.

[57] ABSTRACT

The present invention provides a poppet type directional control valve, in which a valve body and valve disc can be manufactured and assembled in an easier manner and at low cost. In the directional control valve, in which a poppet type valve disc can be switched over and driven by pilot fluid pressure, there are provided on a valve body a first valve bore formed from one end toward a first valve seat, a second valve bore formed from the other end toward a second valve seat, and a communicating valve bore formed from the valve bore and communicating between the first valve seat and the second valve seat. The valve disc includes a first valve disc inserted through the first valve bore and used for opening and closing the first valve seat and a second valve disc inserted through the second valve bore, connected with the first valve disc and used for opening and closing the second valve seat, and these components are made of a material having elasticity and sealing property. The pilot chamber is formed between the first valve disc airtightly inserted in the second valve bore and a manual operating member for closing an opening of the second valve bore.

3 Claims, 5 Drawing Sheets

POPPET TYPE DIRECTIONAL CONTROL VALVE

BACKGROUND OF THE INVENTION

1. Field of the Invention

The present invention relates to a poppet type directional control valve driven by pilot pressure.

2. Discussion of the Background

A poppet type directional control valve is already known, which comprises a supply port for pressure fluid opened to a valve bore where a valve disc is to be inserted, output port opened to said valve bore and with communication to said supply port being blocked when the valve disc is switched over, a discharge port opened to said valve bore and being communicated with the output port when the communication between the supply port and the output port is blocked, and a pilot port opened to a pilot chamber at one end of the valve bore, whereby a first valve seat and a second valve seat are provided between the supply port and the output port and between the output port and the discharge port respectively in said valve bore, there are provided a valve body integrated with these valve seats and a poppet type valve disc to be inserted into said valve bore open or close the first and the second valve seats, said valve disc is switched over by pilot fluid pressure supplied from or discharged to the pilot chamber, and the first and the second valve seats are opened or closed by the pilot fluid pressure.

In the directional control valve already known as described above, a valve disc is designed as a poppet type sealing member for opening and closing valve seats mounted on a flange, which is usually formed by cutting a valve rod or fitting on it.

However, the above directional control valve is disadvantageous in that the arrangement and assembling of the valve body and valve disc are not very easy and simple. The flange has to be manufactured by cutting the valve rod or fitting on the valve rod, and this results in much labor and cost in the manufacture. Because the diameter of the poppet type sealing member is larger than the diameter of the valve seat in the valve body, the insertion of the valve disc into or assembling on the valve bore are very troublesome. Further, the piston for switching over and driving the valve disc must be airtightly inserted in the pilot cheer, and this means an increase in the number of processes in the assembling procedure.

It is a principal object of the present invention to provide a poppet type directional control valve, in which it is possible to mold the valve body and to mold and assemble the valve disc in a simple and easy manner and to manufacture these components at low cost.

It is another object of the present invention to provide a poppet type directional control valve, in which the poppet type valve disc has a very simple arrangement and there is no need to mount a poppet type sealing member on a flange formed by cutting a valve rod or by fitting on it.

It is still another object of the present invention to provide a poppet type directional control valve, in which the number of processes in the assembling procedure is reduced and there is no need to airtightly insert a piston for switching over and driving the valve disc into a pilot chamber.

To attain the above objects, the poppet type directional control valve according to the present invention has a valve body, which comprises a supply port, an output port, a discharge port and a pilot port opened to a valve bore, and a poppet type valve disc is switched over and driven by pilot fluid pressure to a pilot cheer, whereby said valve bore of the valve body comprises a first valve bore formed from one end in axial direction of the valve body via an opening of the supply port toward a first valve seat, a second valve bore formed from the other end in axial direction of the valve body via the pilot chamber and an opening of the discharge port toward a second valve seat, and a communicating valve bore located between the first valve seat and the second valve seat positioned back-to-back to each other and formed from the first valve bore and the second valve bore via an opening of the output port and for communicating these valve bores with each other, the poppet type valve disc comprises a first valve disc inserted through the first valve bore and used for opening and closing the first valve seat, and a second valve disc inserted through the second valve bore, connected integrally with the first valve disc and used for opening and closing the second valve seat, these components being made of a material having elasticity and a sealing property, each component being integrally molded, and said pilot chamber is formed between the second valve disc airtightly inserted into the second valve bore and a closing member for closing an opening of the second valve bore.

In the poppet type directional control valve as described above, a guide for guiding the second valve disc to move in the second valve bore can be integrally provided on the second valve bore or the second valve disc, and the closing member for closing the opening of the second valve bore can be formed as a manual operating member for switching over and driving the valve disc by pressure from outside. Further, in order to introduce output of a small sized solenoid valve into the pilot port and to utilize output of the poppet type directional control valve as pilot fluid for driving a main valve having a large capacity, a supply port, an output port and a discharge port for pressure fluid are opened on a main valve mounting surface on one side of the valve body, and a supply hole and a discharge hole directly communicated with the supply port and the discharge port respectively and a pilot port communicated with the pilot chamber are formed on a solenoid valve mounting surface on the opposite side.

In the poppet type directional control valve with the above arrangement, when the pilot fluid is supplied to or discharged from the pilot chamber, the first valve disc and the second valve disc are integrally moved in the valve bore by the pilot fluid pressure applied on the second valve disc. Thus, it is possible to switch over the communication between the output port or the supply port and the discharge port. In this case, the second valve disc is moved in the second valve bore as it is guided by a guide provided on the second valve bore or on the valve disc itself. Thus, the valve disc can be switched over and driven in stable manner.

When the manual operating member is pushed from outside the valve body, the valve disc is integrally moved, and this makes it possible to switch over the communication between the ports by manual operation.

In the poppet type directional control valve as described above, the valve bore of the valve body comprises a first valve bore formed from one end in axial direction toward the first valve seat, a second valve bore formed from the other end in axial direction via the pilot chamber toward the second valve seat, and a communicating valve bore located between the first valve seat and the second valve seat, formed from the first valve bore and the second valve bore and used for communicating the first and the second valve bores with each other. Accordingly, the valve bores on the valve body can be easily formed, and the valve disc can be easily inserted from both ends in axial direction. Thus, the poppet type valve disc can be easily assembled after formation of the valve body.

In the directional control valve of the present invention, the first valve disc is inserted into the first valve bore from one end in axial direction and the second valve disc is inserted into the second valve bore from the other end. These valve discs are connected at intermediate portion, and there is no need to mount a poppet type sealing member on a flange, which is formed by cutting a valve rod or fitting on it. Thus, the valve discs can be molded in simple and easy manner and can be produced at low cost. Moreover, there is no need to insert the piston for switching over and driving the valve disc separately into the pilot chamber, and this makes it possible to reduce the number of processes in the assembling procedure.

Further, the supply port, the output port and the discharge port are provided on a main valve mounting surface on one side of the valve body, and a supply hole and a discharge hole directly communicated with the supply port and the discharge port respectively and a pilot port communicated with the pilot chamber are provided on a solenoid valve mounting surface on the opposite side. As this poppet type directional control valve is used as a valve for amplifying the pilot fluid, compared with a small size pilot solenoid valve mounted on the solenoid valve mounting surface, it is much easier to connect valves in case pressure fluid is directly supplied from or discharged to the main valve via the valve body. It is also possible to introduce the output of the small size pilot solenoid valve into the pilot port and to use it as a pilot valve for driving the main valve of large capacity.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
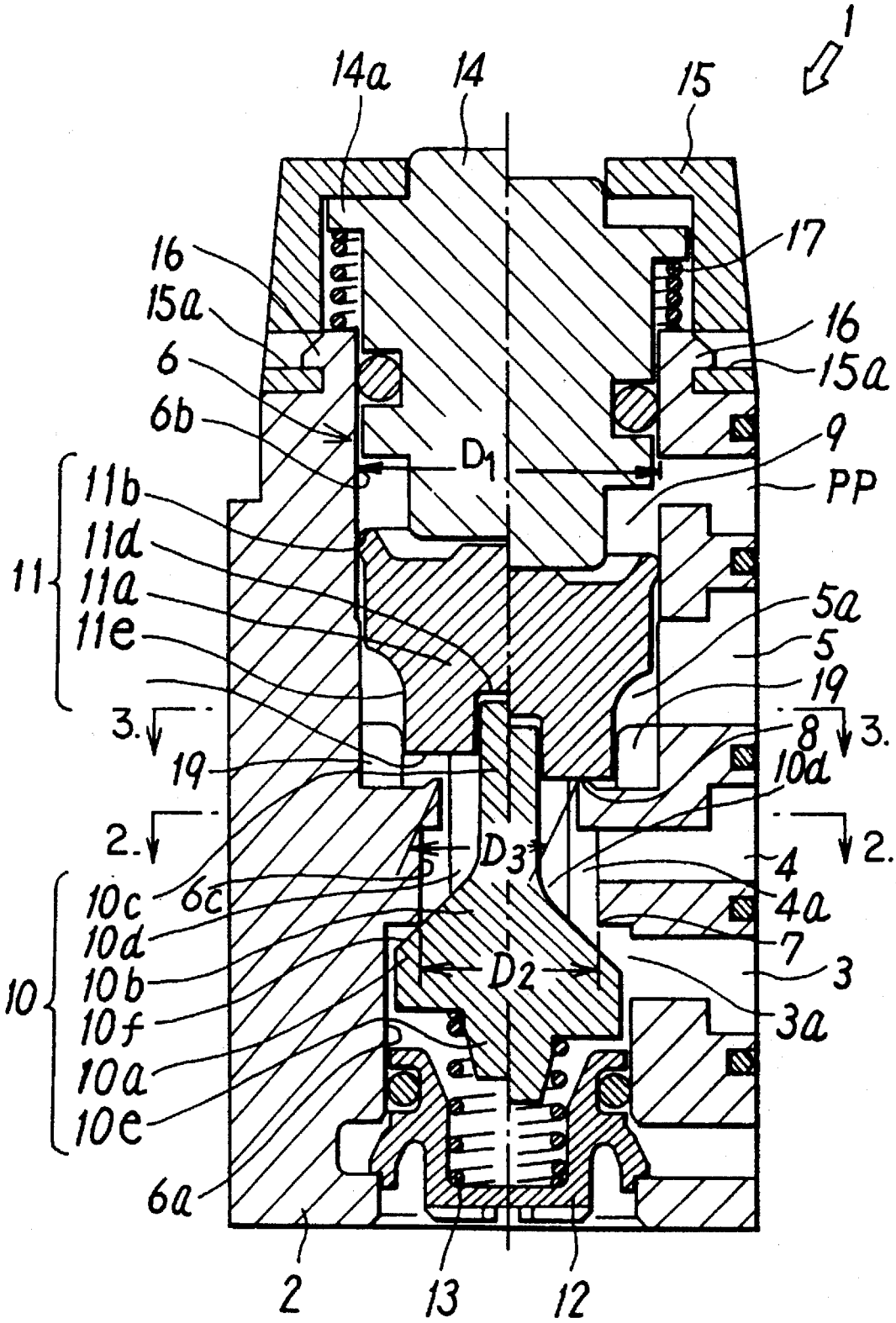
FIG. 1 is a longitudinal sectional view of an embodiment of a poppet type directional control valve of the present invention where different switchover conditions are shown on the right half and the left half of a valve disc.

FIG. 1 represents a first embodiment of a poppet type directional control valve according to the present invention, where a valve body 2 of a directional control valve 1 comprises a supply port 3 for pressure fluid opened to a valve bore 6, into which a valve disc is inserted, an output port 4 opened to said valve bore 6 and with communication to said supply port blocked by switchover operation of the valve disc, a discharge port 5 opened to said valve bore 6 and communicated with said output port 4 when communication between said supply port 3 and said output port 4 is blocked, and a pilot port PP opened to a pilot chamber 9 on one end of said valve bore 6, whereby there are further provided a first valve seat 7 and a second valve seat 8 between the supply port 3 and the output port 4 and between the output port 4 and the discharge port 5 in said valve bore 6. These components are made of hard synthetic resin or aluminum and are integrally molded.

The valve bore 6 comprises a first valve bore **6*a* from one end in an axial direction (the lower end in FIG. 1) to a portion closer to the first valve seat 7 through an opening 3*a* of the supply port 3, a second valve bore 6*b* formed from the other end in axial direction to the second valve seat 8 through the pilot chamber 9 and an opening 5*a* of the discharge port 5, and a communicating valve bore 6*c* located between the first valve seat 7 and the second valve seat 8 positioned back-to-back to each other, being formed from the first valve bore 6*a* through an opening 4*a* of the output port 4 and communicating these valve bores 6*a* and 6*b*** with each other.

To facilitate the formation of the valve body 2 by use of a mold, the diameter of the first valve bore **6*a* is at least not enlarged from the opening at one end in axial direction toward the first valve seat 7 and is gradually reduced in general, and the communicating valve bore 6*c* is gradually reduced in diameter and is connected with the valve bore 6*a*. On the other hand, the second valve bore 6*b* is also gradually reduced in diameter in general from the opening toward the second valve seat 8** at least not being enlarged in diameter.

In this case, the inner diameter D1 of the second valve bore **6*b* in the pilot chamber 9 is designed larger than the diameter D2 of the first valve seat 7 and the diameter D3 of the second valve seat 8, and the diameter D2 of the first valve seat 7 is designed larger than the diameter D3 of the second valve seat 8**.

However, the communicating valve bore **6*c* may be connected so that it is gradually reduced in diameter from tip of the second valve bore 6*b*. In this case, the diameter D3 of the second valve seat 8 is designed larger than the diameter D2 of the first valve seat 7**.

A poppet type first valve disc 10 slidably inserted into the valve bore **6*a* from its opening comprises a cylindrical portion 10*a* freely inserted into the first valve bore 6*a*, a conical portion 10*b* forming a sealing surface 10*f* to open or close the first valve seat 7 by touching or separated from it, a projection 10*c* protruding into the second valve bore 6*b* from the conical portion 10*b* through the communicating valve bore 6*c*, a plurality of ribs 10*d* in axial direction formed on outer periphery except the tip of the projection, and a valve spring retainer 10*e* protruding to the side opposite to the projection 10*c***.

On the other hand, a poppet type second valve disc 11 slidably inserted into the second valve bore **6*b* from its opening comprises an annular sealing surface 11*c* for opening and closing the second valve seat 8, a main unit 11*a* having a recess 11*d* for joining at its center and a curved recess 11*e* for enlarging flow passage and formed on outer periphery of the sealing surface 11*c*, and a seal lip 11*b* provided on outer periphery on the opposite side and airtightly contacting the second valve bore 6*a***.

The first valve disc 10 and the second valve disc 11 are made of a material having elasticity and sealing property such as synthetic rubber and are separately molded as integral units respectively.

The opening of the first valve bore 6*a* is airtightly closed by a spring seat 12, which serves as a closing member, and a valve spring 13 for pushing a sealing surface 10*f* of the first valve disc 10 against the first valve seat 7 is placed in a contracted form between the spring seat 12 and the valve spring retainer 10*e* of the first valve disc 10.

Into the opening of the second valve bore 6*b*, a manual operating member 14 capable of pushing the second valve disc 11 by manual operation is airtightly and slidably inserted to define the pilot chamber 9 between the manual operating member and the second valve disc 11. A return spring 17 is placed in a contracted form between a flange 14*a* on the manual operating member 14 and the valve body 2. On the valve body 2, a cover 15 is placed to restrict protrusion of the manual operating member 14 from the second valve bore 6*b* as it is brought into contact with the flange 14*a* of the manual operating member 14. A plurality of engaging projections 16 for locking the cover 15 are protruded on outer peripheral surface of the valve body 2, and engaging holes 15*a* on the cover 15 is engaged with the engaging projections 16 to mount the cover 15 on the valve body 2.

In case the manual operating member 14 is not needed, the opening of the second valve bore 6*b* may be closed by the closing member, which is designed similarly to the spring seat 12 of the first valve bore 6*a*.

Figure 2:
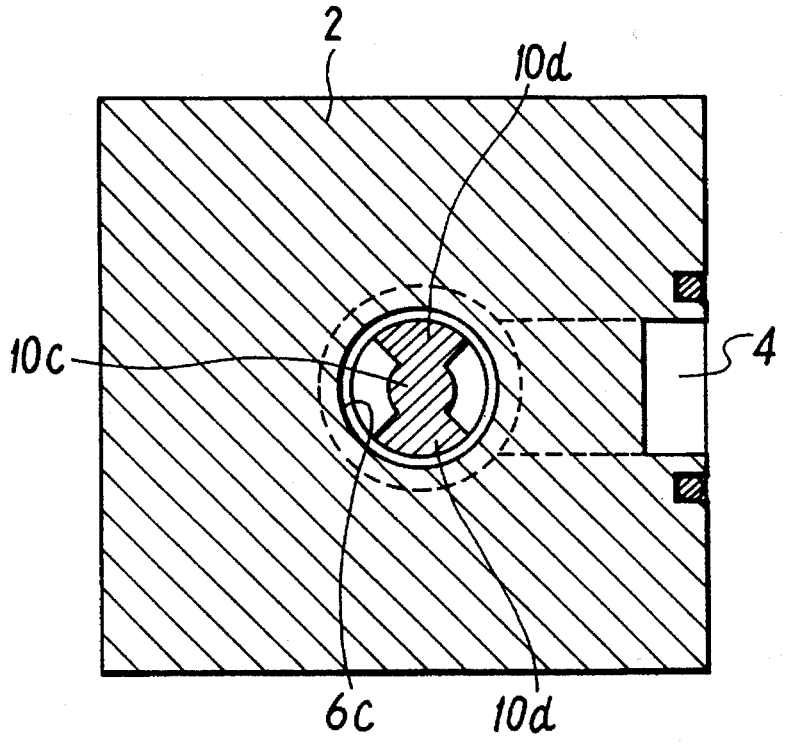
FIG. 2 is a cross-sectional view along the line 2—2 in FIG. 1.

As it is evident from FIG. 1 and FIG. 2, a plurality of ribs 10*d* on the first valve disc 10 form flow passages of pressure fluid between and around themselves and also define insertion limit of the projection 10*c* of the first valve disc 10 inserted into the recess 11*d* of the second valve disc 11.

Figure 3:
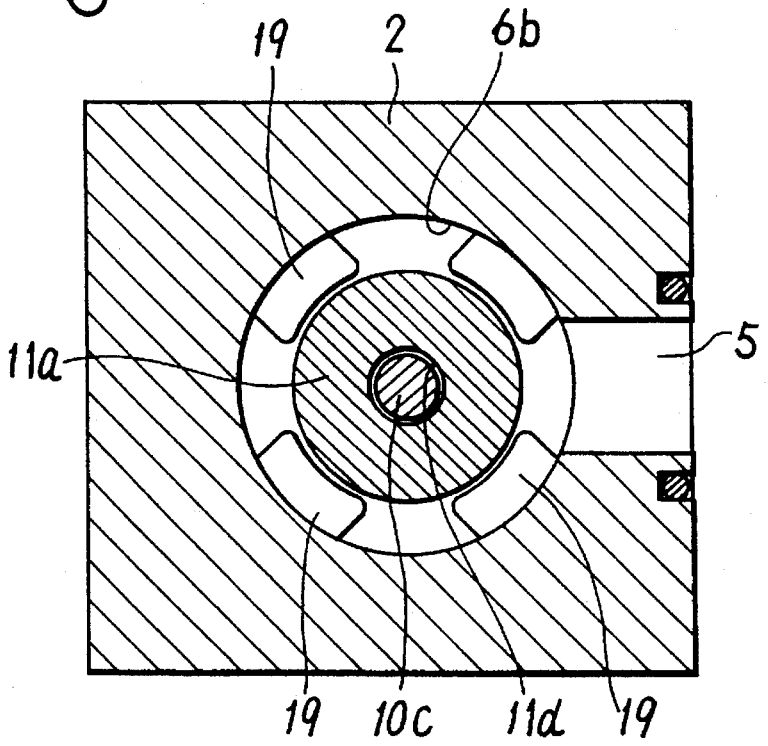
FIG. 3 is a cross-sectional view along the line 3—3 in FIG. 1.

As shown in FIG. 1 and FIG. 3, the second valve disc 11 is guided to slide by rib-like guides 19 provided around the second valve seat 8 in the second valve bore 6*b*, and flow passages of pressure fluid are enlarged between a plurality of guides 19.

The first valve disc 10 and the second valve disc 11 are centered by inserting the projection 10*c* of the first valve disc 10 into the recess 11*d* of the second valve disc 11.

The valve body 2 of the poppet type directional control valve having the above arrangement can be integrally molded from a material such as plastics or light alloy by placing cores for forming the first valve bore 6*a*, the second valve bore 6*b* and the communicating valve bore 6*c* into a mold and further by inserting cores for forming the ports into molds. Because the first valve bore 6*a* and the communicating valve bore 6*c* are reduced in diameter toward the second valve seat 8 and the second valve bore 6*b* is designed with an approximately cylindrical shape, these cores can be easily removed after molding. Therefore, the valve body 2 can be easily molded.

From the openings of the first valve bore 6*a* and the second valve bore 6*b* formed on the valve body 2, the first valve disc 10 and the valve spring 13 as well as the second valve disc 11 and the manual operating member 14 with the return spring 17 are inserted. By closing the openings of the two valve bores by the spring seat 12 and the cover 15, these components can be assembled on the valve body 2. In this case, the first valve disc 10 and the second valve disc 11 can be separately inserted into the first valve bore 6*a* and the second valve bore 6*b*, and these valve discs can be easily assembled into the valve bore 6.

Because the first valve disc 10 and the second valve disc 11 are molded from the material having elasticity and a sealing property and these are connected together, there is no need to engage the sealing member into the valve disc or to provide a valve rod to integrally move these valve discs; This contributes to easy assembling at low cost.

Describing now the operation of the poppet type directional control valve in detail, when the pilot air pressure in the pilot chamber 9 is exhausted, the first valve disc 10 closes the first valve seat 7 by resilient force of the valve spring 13 as shown in the left half of FIG. 1, and, being pushed by the rib 10*c*, the second valve disc 11 integrally moving with it opens the second valve seat 8. As a result, the communication between the supply port 3 and the output port 4 is blocked, and the output port 4 and the discharge port 5 are communicated with each other.

When the pilot air pressure is supplied to the pilot chamber 9, the second valve disc 11 pushed by the pilot air pressure closes the second valve seat 8, and the first valve disc 10 opens the first valve seat 7. As a result, the supply port 3 and the output port 4 are communicated with each other, while the communication between the output port 4 and the discharge port 5 is blocked. Therefore, compressed air in the supply port 3 is issued from the output port 4.

When the manual operating member 14 is pushed with the communication between the supply port 3 and the output port 4 blocked as shown in the left half of FIG. 1, it is turned to the same switchover status as the case where the pilot air pressure is supplied as shown in the right half of FIG. 1. Therefore, in case the pilot fluid pressure is lost from some reason, the directional control valve 1 can be operated manually.

Figure 4:
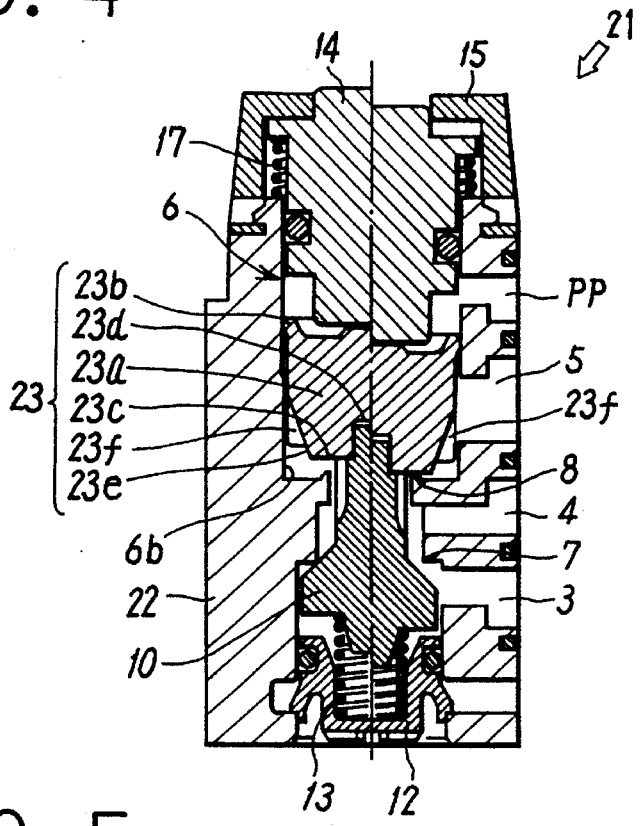
FIG. 4 is a longitudinal sectional view of a second embodiment of the present invention showing different switchover conditions on the right half and the left half of a valve disc.

FIG. 4 represents a second embodiment of the present invention where a valve body 22 in a directional control valve 21 of the second embodiment is not equipped with the guide 19 as provided in the second valve bore 6*b* of the first embodiment. In this respect, a poppet type second valve disc 23 for opening and closing the second valve seat 8 comprises an annular sealing surface 23*c*, a recess 23*d* for joining at its center, a curved recess 23*e* for enlarging flow passage formed on outer periphery of the sealing surface 23*c* and a main unit 23*a* having a plurality of rib-like guides 23*f* protruded to be guided along inner surface of the second valve bore 6*b* in the curved recess 23*e*, and an annular seal lip 23*b* airtightly and slidably moved along inner surface of the second valve bore 6*a*.

The arrangement and the operation of the second embodiment are the same as those of the first embodiment except that the sliding of the second valve disc 23 is guided to slide by a guide 23*d*. Therefore, the same component as in the first embodiment is referred by the same symbol, and detailed description is not given here.

Figure 5:
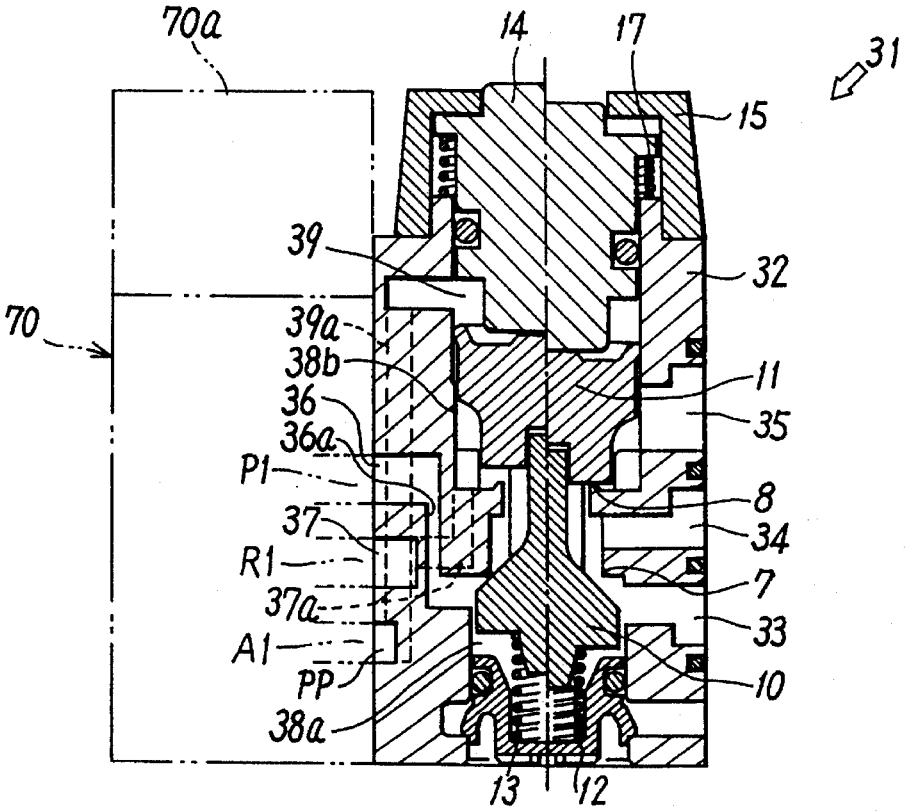
FIG. 5 is a longitudinal sectional view of a third embodiment of the present invention showing different switchover conditions on the right half and the left half of a valve disc.

FIG. 5 represents a third embodiment of the present invention. A valve body 32 of a directional control valve 31 in the third embodiment comprises a supply port 33, an output port 34, and a discharge port 35 for compressed air opened on a side as in the first embodiment, while a supply hole 36, a pilot port PP and a discharge hole 37 are opened on the opposite side of the valve body 32. The supply hole 36 is directly communicated with the supply port 33 through a supply passage 36*a* and a valve bore 38*a*. The pilot port PP is communicated with a pilot chamber 39 through a pilot passage 39*a*, and the discharge hole 37 is directly communicated with the discharge port 35 through a discharge passage 37*a* and a valve bore 38*b*.

The other arrangement of the third embodiment is the same as the first embodiment. Thus, the same component as in the first embodiment is referred by the same symbol, and a detailed description is thereof not given here.

As to be described later, the directional control valve 31 of the third embodiment is advantageous in that a pilot solenoid valve is mounted on a surface where a supply hole 36, a pilot port PP and a discharge hole 37 are formed and a fluid pressure equipment mounted on the surface where the supply port 33, the output port 34 and the discharge port 35 are formed is driven by a pressure fluid, whose flow rate is increased by the directional control valve 31.

Figure 6:
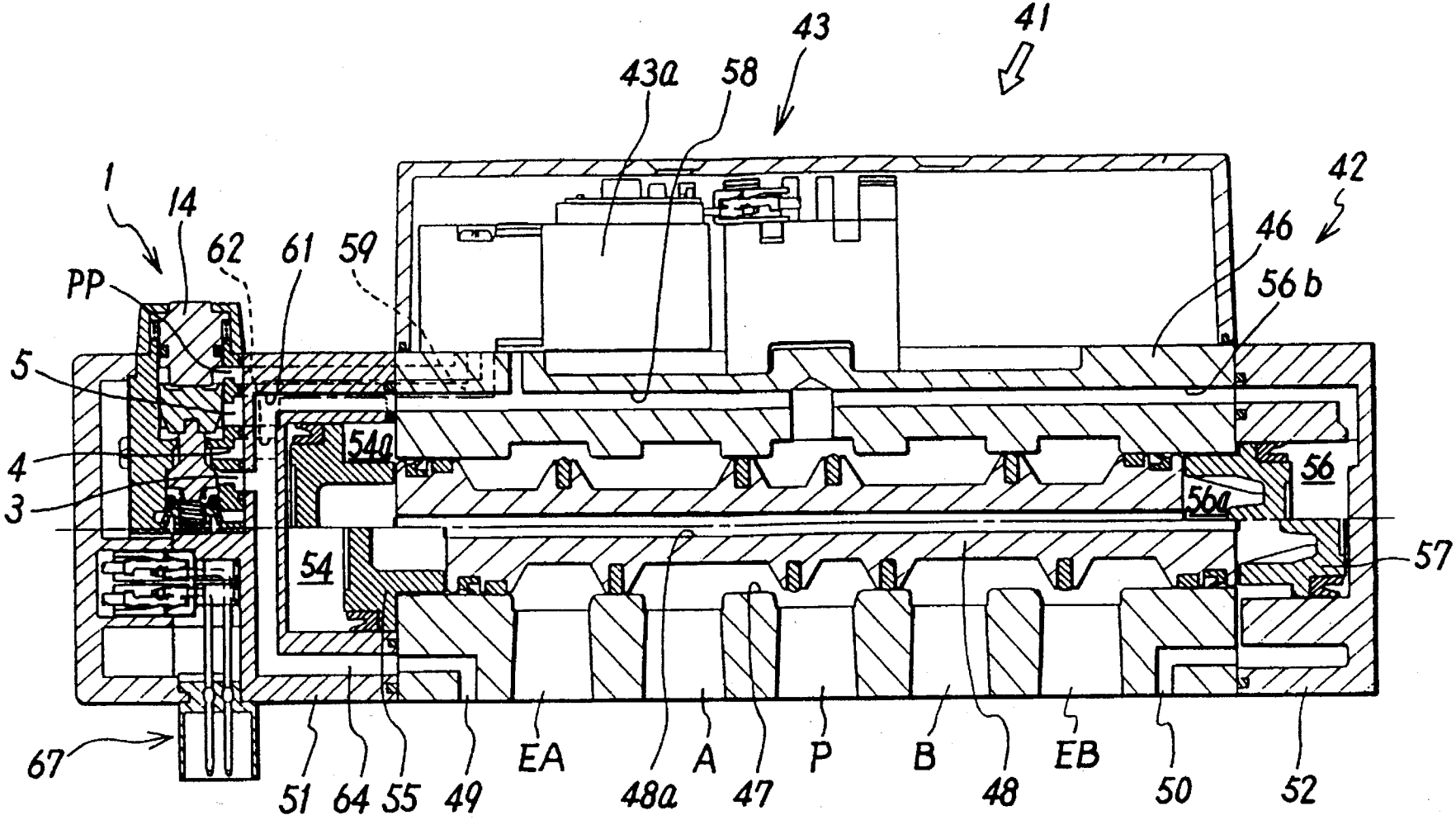
FIG. 6 is a longitudinal sectional view of a directional control valve of the first embodiment in operating condition.
Figure 7:
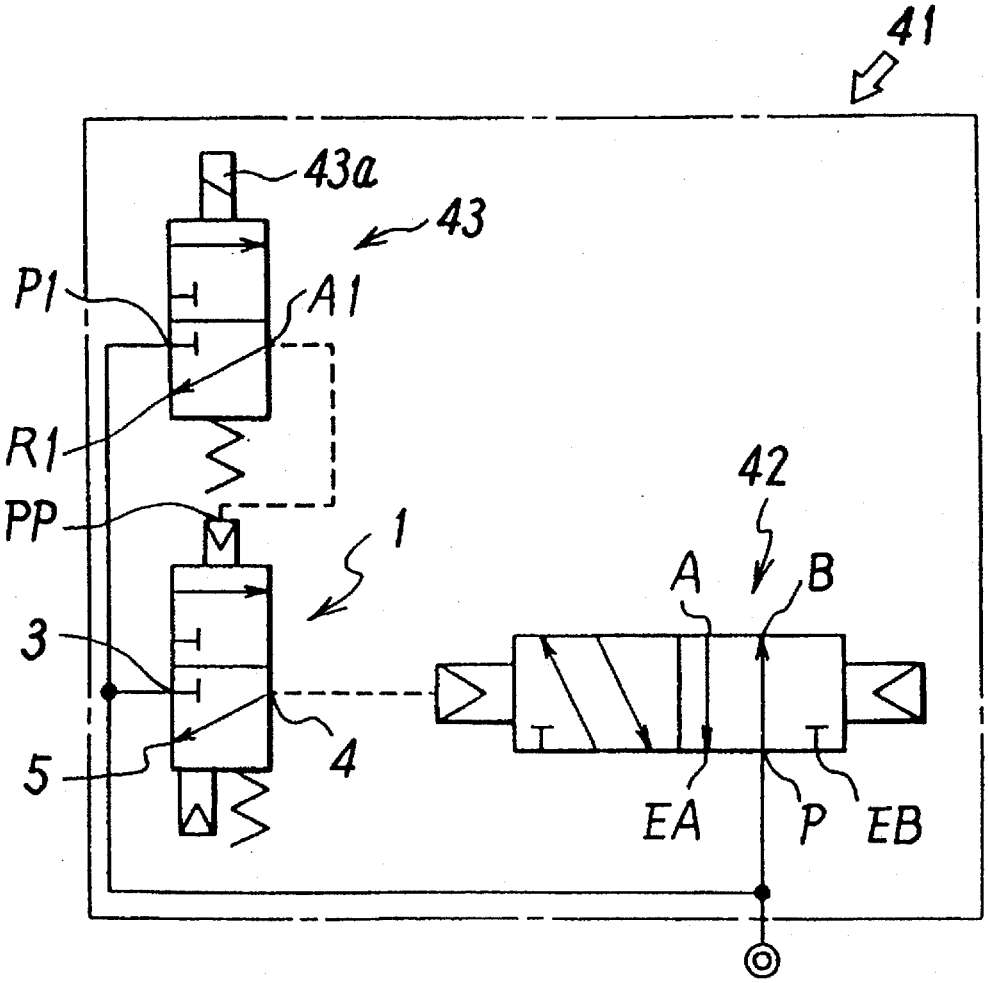
FIG. 7 is a block diagram showing an arrangement of the pilot type valve of FIG. 6 by symbol marks.

FIG. 6 and FIG. 7 each represents an example of an operating aspect of the directional control valve 1 of the first embodiment.

In this operating aspect, the directional control valve 1 is utilized on a pilot valve 41. The directional control valve 1 is opened or closed by pilot fluid from a pilot solenoid valve 43, which is small in capacity and low in power consumption, and its output is supplied to or discharged from a main valve pilot chamber of a main valve 42 having large capacity.

A valve main unit 46 of the main valve 42 in this pilot valve 41 is installed on a mainfold base (not shown), and the directional control valve 1 is mounted on one side in axial direction of the main valve 42, and the pilot solenoid valve 43 is mounted on upper surface of the valve main unit 46.

The valve main unit 46 comprises a main valve supply port P, main valve output ports A and B and a valve bore 47 running in axial direction having main valve discharge ports EA and EB and with these ports opened on it. Into the valve bore 47, a valve disc 48 for switching over and communicating main valve output ports A and B with the main valve discharge ports EA and EB is slidably inserted. 0n lower surface of the valve main unit 46, an external pilot port 49 and a breather port 50 are provided in addition to the above ports.

The main valve 42 and the manifold base are arranged in such manner that, when the valve main unit 46 is installed on the manifold base, the ports provided on lower surface of the valve main unit 46 are communicated with the corresponding ports on the manifold base.

On one end in axial direction of the valve main unit 46, a first piston box 51 and a second piston box 52 are mounted. A first piston 55 is slidably inserted into a main valve pilot chamber 54 formed in the first piston box 51, and a second piston 57 is slidably inserted into a return pressure chamber 56, which is formed in the second piston box 52 and has smaller pressure receiving area than that of the main valve pilot chamber 54. A valve disc 48 is pushed by these pistons 55 and 57 to slide. On the valve disc 48, a through-hole **48*a* is formed in axial direction for communicating breather chambers 54*a* and 56*a* behind the first piston 55 and the second piston 57, and the return pressure chamber 56 is communicated with the main valve supply port P by a flow passage 56*b***.

The pilot solenoid valve 43 as schematically shown in FIG. 6 comprises a first pilot supply port P1, a first pilot output port A1, and a first pilot discharge port R1 as shown by symbol marks in FIG. 7. It is designed as a 3-port solenoid valve of known type, which is operated by excitation and release of a solenoid **43*a*** to switch over the first pilot output port A1 to the first pilot supply port P1 and the first pilot discharge port R and to communicate them with each other.

The first pilot supply port P1 is communicated with a main valve supply port P via a first pilot supply passage 58 formed on the valve main unit 46, and the first pilot output port A1 is communicated with the pilot port PP of the directional control valve 1 via a first pilot output passage 59. The first pilot discharge port R1 is communicated with a breather chamber **54*a* via a passage (not shown) and is communicated with the outside via a through-hole 48*a*, the breather chamber 56*a* and the breather port 50**.

The supply port 3 of the directional control valve 1 is communicated with the main valve supply port P via a second pilot supply passage 61 communicated with the first pilot supply passage 58, and the output port 4 is communicated with the main valve pilot chamber 54 via a second pilot output passage 62. The discharge port 5 is communicated with the breather chamber **54*a* via a passage (not shown) and is communicated with outside via the through-hole 48*a*, the breather chamber 56*a* and the breather port 50 of the valve disc 48**.

The directional control valve 1 is designed with such a capacity that a large quantity of pilot air can be supplied within short time to the main valve pilot chamber 54 of the main valve 42 having large capacity, and it is mounted on a side of the first piston box 51 with the manual operating member 14 facing upward.

The external pilot port 49 provided on the valve main unit 46 is communicated with the second pilot supply passage 61 via an external pilot passage 64. Therefore, the pilot valve 41 may be designed as an internal pilot type or external pilot type as necessary.

In case it is designed as an internal pilot type, the external pilot port 49 should be closed by adequate means such as a ball (not shown). In case it is designed as an external pilot type, it is necessary to block the communication of the main valve supply port P of the main valve 42 with the first pilot supply passage 58 and the passage **56*b***.

On the lower portion of the directional control valve 1, a power feeding unit 67 for feeding power to the solenoid **3*a* of the pilot solenoid valve 43 is mounted. The power feeding unit 67 is electrically connected to a terminal of the solenoid 43*a* of the pilot solenoid valve 43 through a lead wire (not shown), and it is electrically connected with a power feeding terminal on the manifold base when the main valve 42** is installed on a manifold base.

In this pilot operated valve 41, when the solenoid **43*a* of the pilot solenoid valve 43 is not excited, the pilot air pressure is not supplied to the pilot port PP of the directional control valve 1, and the pilot air in the main valve pilot chamber 54 is discharged to outside through the discharge port 5. Thus, the valve disc 48 is moved leftward in the figure by action of the air pressure in the return pressure chamber 56. As a result, the main valve supply port P is communicated with the main valve output port B, and the main valve output port A is communicated with the main valve discharge port EA. (see upper half of the valve disc 48 in FIG. 6**).

When the solenoid 43 of the pilot solenoid valve 43 is excited by the power feeding unit 67, the first pilot output port A1 is communicated with the first pilot supply port P1, and pilot air is supplied to the pilot port PP of the directional control valve 1. As a result, the output port 4 is communicated with the supply port 3, and the pilot air is supplied to the main valve pilot chamber 54. Therefore, due to the difference of pressure receiving area between the main valve pilot chamber 54 and the return pressure chamber 56, the first piston 55 is moved rightward in the figure and pushes the valve disc 48. Thus, the main valve supply port P is communicated with the main valve output port A, and the main valve output port B is communicated with the main valve discharge port EB. (See lower half of the valve disc 48 in FIG. 6.).

When excitation of the solenoid 43*a* is discontinued, the first pilot output port A1 of the pilot solenoid valve 43 is communicated with the first pilot discharge port R1, and the air in the pilot port PP of the directional control valve 1 is discharged to outside. As a result, the valve discs 10 and 11 are restored to their initial positions by the resilient force of the valve springs, and the output port 4 is communicated with the discharge port 5. The pilot air in the main valve pilot cheer 54 is discharged to outside, and the valve disc 48 is moved back to the initial position by the air pressure in the return pressure chamber 56 applied on the second piston 57.

The communication between the ports by the valve disc 48 of the main valve 42 is switched over by a large quantity of pilot air corresponding to the volume of the pilot chamber supplied to the main valve pilot chamber 54 from the directional control valve 1. Accordingly, even when the pilot solenoid valve 43 is small in size and low in power consumption, the main valve 42 is operated with good response. This contributes to the operation of the directional control valve 1 at lower cost and also to the use of the pilot operated solenoid valve 41 with good response and at lower cost.

In the discussion above, a description has been given on the case where the directional control valve 1 is assembled on a pilot operated solenoid valve 41 and is used, while the directional control valve of the present invention is not limited to such operating aspects.

The directional control valve 31 of the third embodiment as shown in FIG. 5 is suitable for the operation where the pilot solenoid valve 43 of the pilot operated valve 41 as described in connection with FIG. 6 is mounted on a surface where the supply hole 36, the pilot port PP and the discharge hole 37 are opened in the directional control valve 31. Therefore, similarly to the pilot solenoid valve 43, the pilot solenoid valve 70 of FIG. 5 comprises a first pilot supply port P1, a first pilot output port A1, and a first pilot discharge port R1, and the first pilot output port A1 is switched over to the first pilot supply port P1 and the first pilot discharge port R and is communicated with these ports by excitation and deactivation of the solenoid 70*a*.

It is possible according to the poppet type directional control valve of the present invention to manufacture the valve, in which molding of valve body and molding and assembling of valve disc can be carried out in simple and easy manner at lower cost.

Specifically, the valve disc of poppet type can be designed in a very simple manner because there is no need to mount poppet type sealing member on a flange, which is formed by cutting or fitting on a valve rod. The molding and the assembling can be carried out in a simple and easy manner because the valve discs are made of a material having elasticity and sealing property.

According to the present invention, there is no need to insert a piston for switching over and driving the valve disc into a pilot chamber, and it is possible to provide a poppet type directional control valve with fewer number of processes in the assembling procedure.

Obviously, additional modifications and variations of the present invention are possible in light of the above teachings. It is therefore to be understood that within the scope of the appended claims, the invention may be practiced otherwise than as specifically described herein.

What we claim are:

1. A poppet type directional control valve, comprising:

a valve body which includes a valve bore, a supply port for pressure fluid opened to said valve bore, a valve disc inserted in said valve bore, an output port opened to said valve bore and in communication with said supply port so as to be blocked by switchover operation of the valve disc, a discharge port opened to said valve bore and communicated with the output port when communication between said supply port and said output port is blocked, and a pilot port opened to pilot chamber at one end of said valve bore, wherein a first valve seat and a second valve seat are provided between the supply port and the output port and between the output port and the discharge port in said valve bore;

a poppet type valve disc inserted into said valve bore, said poppet type valve disc opening and closing the first valve seat and the second valve seat wherein said valve disc is switched over and driven by pilot fluid pressure supplied from or discharged to the pilot chamber to open or close the first valve seat and the second valve seat;

the valve bore of said valve body comprises a first valve bore formed from one end in an axial direction of the valve body via an opening of the supply port toward the first valve seat, a second valve bore formed from the other end in the axial direction of the valve body via the pilot chamber and an opening of the discharge port toward the second valve seat, and a communicating valve bore located between the first valve seat and the second valve seat, formed from the first valve bore and the second valve bore via the opening of the output port and communicating said first valve bore with said second valve bore;

said poppet type valve disc comprising a first valve disc inserted into the first valve bore, said first valve disc opening and closing the first valve seat and a second valve disc inserted through the second valve bore and connected integrally with the first valve disc to open or close the second valve seat wherein said first and second valve discs are made of a elastic material having a sealing property, and each of said first and second valve discs are integrally molded;

said pilot chamber is formed between the second valve disc, said second valve disc being airtightly inserted into the second valve bore, and a closing member closing an opening of the second valve bore wherein:

each of said suddenly port, output port and discharge port as well as each of said first and second valve seats are located in said valve body;

said first valve bore is formed without the diameter thereof being enlarged from one end of the valve body toward said first seat and said second valve bore is formed without the diameter thereof being enlarged from the other end of the valve body towards said second valve seat, and said communicating valve bore is formed without the diameter thereof being enlarged in a direction from the first valve seat toward the second valve seat;

an inner diameter D1 of the second valve bore, a diameter D2 of the first valve seat and a diameter D3 of a second valve seat have a relationship such that D1>D2>D3; and wherein the supply port is opened and closed solely by contact of the first valve disc with said first valve seat and the output port is opened and closed solely by contact of the second valve disc with said second valve seat.

2. A poppet type directional control valve according to claim 1, wherein a guide is provided guiding the second valve disc so as to move in the second valve bore wherein said guide is integrally provided on one of the second valve bore and the second valve disc.

3. A poppet type directional control valve according to claim 1, wherein the closing member closing the opening of the second valve bore comprises a manual operating member switching over and driving the valve disc by pressure from outside the valve body.

* * * * *